US006709057B2

(12) United States Patent
Sander et al.

(10) Patent No.: US 6,709,057 B2
(45) Date of Patent: Mar. 23, 2004

(54) CHAIR, IN PARTICULAR OFFICE CHAIR

(75) Inventors: Armin Sander, Waldstrasse 49, D-90763, Fürth (DE); Martin Potrykus, Bamberg (DE)

(73) Assignee: Armin Sander, Nuremberg (DE)

( * ) Notice: Subject to any disclaimer, the term of this patent is extended or adjusted under 35 U.S.C. 154(b) by 0 days.

(21) Appl. No.: 09/895,103

(22) Filed: Jun. 29, 2001

(65) Prior Publication Data

US 2004/0026973 A1 Feb. 12, 2004

(30) Foreign Application Priority Data

May 11, 2001 (DE) ..... 101 22 945

(51) Int. Cl.[7] ..... A47C 1/02

(52) U.S. Cl. ..... 297/316; 297/300.1; 297/320; 297/300.2

(58) Field of Search ..... 297/300.1, 300.2, 297/316, 320, 321

(56) References Cited

U.S. PATENT DOCUMENTS 5,080,435 A * 1/1992 Desanta ..... 297/316
5,308,144 A * 5/1994 Korn ..... 297/300.2
5,423,594 A * 6/1995 Hancock et al. ..... 297/300.2
5,775,774 A * 7/1998 Okano ..... 297/300.2
6,000,755 A * 12/1999 Uhlenbrock ..... 297/300.2

FOREIGN PATENT DOCUMENTS

| | | |
|---|---|---|
| DE | 37 35 256 C2 | 4/1989 |
| DE | 42 19 599 A1 | 12/1993 |
| EP | 0 247 311 B1 | 12/1987 |

* cited by examiner

*Primary Examiner*—Peter M. Cuomo
*Assistant Examiner*—Erika Garrett
(74) *Attorney, Agent, or Firm*—Laurence A. Greenberg; Werner H. Stemer; Ralph E. Locher

(57) ABSTRACT

A chair, in particular an office chair, is described. The chair has a backrest that is inclinable with regards to a seat carrier via a backrest carrier. The chair has a seat surface that can be moved synchronously with the backrest and is supported on the seat carrier via at least one seat link. A coupling link is provided for synchronization between the movement of the backrest and the movement of the seat surface. The coupling link is connected rotatably, on one side to the seat surface and, on another side, to the backrest link.

5 Claims, 4 Drawing Sheets

CHAIR, IN PARTICULAR OFFICE CHAIR

BACKGROUND OF THE INVENTION

Field of the Invention

The invention relates to a chair, in particular an office chair. The chair has an inclinable backrest connected to a backrest carrier and the backrest carrier is supported on a seat carrier. A seat surface is provided which can be moved synchronously with the backrest. The seat surface is supported on the seat carrier via at least one seat link.

Seating furniture and, in particular, chairs in which the seat surface and the backrest move synchronously are used with various synchronizing mechanisms. The synchronizing mechanism serves to change the position of the seat surface at the same time as the backrest is adjusted.

A chair with synchronously adjustable inclination of the backrest and the seat is thus known from German Patent DE 37 35 256 C2. In the case of the chair, with a two-part seat surface, the rear edge of the seat surface is likewise lowered as the backrest is inclined. In its front region, the two-part seat surface is articulated on a non-pivotable seat carrier on each side by way of a pair of levers. In the rear region, the seat surface is connected rotatably on each side to a retaining part that is disposed rigidly on a rear carrier, the rear carrier being connected rigidly to the backrest. The seat surface is supported on the backrest carrier by way of its rear region. However, the two-part configuration of the seat surface, which is connected to a plurality of carriers of the chair by a total of two pairs of levers and two rotary articulations, involves a high outlay.

SUMMARY OF THE INVENTION

It is accordingly an object of the invention to provide a chair, in particular an office chair which overcomes the above-mentioned disadvantages of the prior art devices of this general type, which has a particularly suitable synchronizing mechanism which can be realized in a straightforward manner.

With the foregoing and other objects in view there is provided, in accordance with the invention, a chair containing a seat carrier, a backrest carrier, a backrest supported on the backrest carrier and the backrest is able to be inclined in regards to the seat carrier, a seat surface, and at least one seat link connected to the seat carrier and to the seat surface. The seat surface is able to be moved synchronously with the backrest and is supported on the seat carrier through the at least one seat link. A coupling link for synchronization of a movement of the backrest and a movement of the seat surface is provided. The coupling link is connected rotatably, on a first side, to the seat surface and, on a second side, to the backrest carrier.

A coupling link is provided for synchronization between the movement of the seat surface and the movement of the backrest, the coupling link being connected rotatably, on one side, to the seat surface and, on the other side, to the link of the backrest.

The invention is based here on the consideration that, in the case of a chair or piece of seating furniture with an adjustable seat surface and adjustable backrest, the possible adjustments of the seat surface, on the one hand, and backrest, on the other hand, may first of all be regarded independently of one another. The configuration thus initially has two degrees of freedom. The possible adjustment of the backrest here has just a single degree of freedom if the backrest is articulated on the seat carrier in a straightforward manner via the backrest carrier, which is connected rigidly to the backrest and is fastened rotatably on the seat carrier via a single rotary spindle. Furthermore, the seat surface may have more complex possible adjustments, although, in a manner analogous to the adjustability of the backrest, it may be assumed that it is also possible to describe the possible adjustments of the seat surface with a single degree of freedom. The movement of the seat surface here may be both a translation and a tilting movement or a combination of different types of movement.

Coupling of the movements of the seat surface, on the one hand, and of the backrest, on the other hand, should first of all ensure here that each possible position of the backrest is assigned a position of the seat surface, as a result of which the entire configuration is limited to one degree of freedom. These requirements and a coupling mechanism which is of both permanently stable and straightforward configuration are fulfilled by a coupling link which is connected rotatably both to the seat surface and to the link of the backrest.

In an advantageous configuration, the seat surface is articulated on the seat carrier by two seat links or two respectively parallel pairs of links. In this case, the seat links are connected rotatably both to the seat carrier and to the seat surface. A seat link that is disposed in the front region of the seat surface, that is to say in the front half of the seat surface, which is directed away from the backrest, advantageously also serves here for length compensation in the case of an inclination of the backrest with the seat surface moved synchronously rearward and downward. An alternative configuration to this is a slot guide in the front region of the seat surface, in the case of which a spindle provided there on the underside of the seat surface is guided in an expediently horizontally running slot provided on the seat carrier.

In the configuration with the seat link, mounted rotatably on both end sides, in the front seat region for length compensation, the seat link is disposed in an inclined manner. In this case, the distance between a first, top point of rotation and the backrest, the front seat link being connected to the seat surface via the point of rotation, is smaller than the distance between a second point of rotation and the backrest. The first, front seat link being connected rotatably to the seat carrier via the second point of rotation.

In order to achieve mechanical loading and particularly suitable synchronization of the movements of the seat surface and of the backrest, a second seat link, which is provided in the rear seat region, i.e. in that half of the seat surface which is directed toward the backrest, is likewise disposed in an inclined manner.

For this purpose, the second seat link is connected rotatably, on the one hand, to the seat surface via a third point of rotation and, on the other hand, to the seat carrier via a fourth point of rotation. The distance between the third, top point of rotation and the backrest, in turn, is smaller than the distance between the bottom, fourth point of rotation and the backrest. It is expedient here for the angle of the rear, second seat link to the vertical to be greater than the angle of the front, first seat link to the vertical.

By virtue of the inclined configuration of the front, first seat link, which acts as length-compensation element, raising of the front edge of the seat surface as the backrest is inclined back is avoided in that, as the backrest is inclined back, the top point of rotation of the front seat link connected to the seat surface is lowered. The lowering action becomes more pronounced the more the inclination of the two seat links deviates from the vertical.

From the point of view of ergonomics, the comfort is increased by the comparatively pronounced inclination of the rear seat link in relation to the inclination of the front seat link in that, as the backrest is inclined back, the seat surface is lowered predominantly in its rear region. For this purpose, the rear, second seat link connected to the seat surface is at least 25% longer than the front, first seat link connected to the seat surface. As a result, the seat surface achieves, as desired, a greater freedom of movement in its rear region than in its front region.

In a particularly advantageous configuration, the point of rotation of the coupling link, provided for synchronization purposes, on the seat surface coincides with the point of rotation of the rear seat link, which connects the seat surface to the seat carrier. In order to achieve, in addition, both a particularly favorable kinematic functioning of the coupling mechanism and, at the same time, easy controllability of the mechanical loading states of the moving components, with the backrest not in an inclined position, the rear (second) seat link is expediently articulated on the seat surface, on the one hand, and on the seat carrier, on the other hand, such that it runs obliquely by an angle $\beta=(45\pm30)°$ in relation to the vertical. It is preferably the case that $\beta=(50\pm10)°$.

Other features which are considered as characteristic for the invention are set forth in the appended claims.

Although the invention is illustrated and described herein as embodied in a chair, in particular an office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
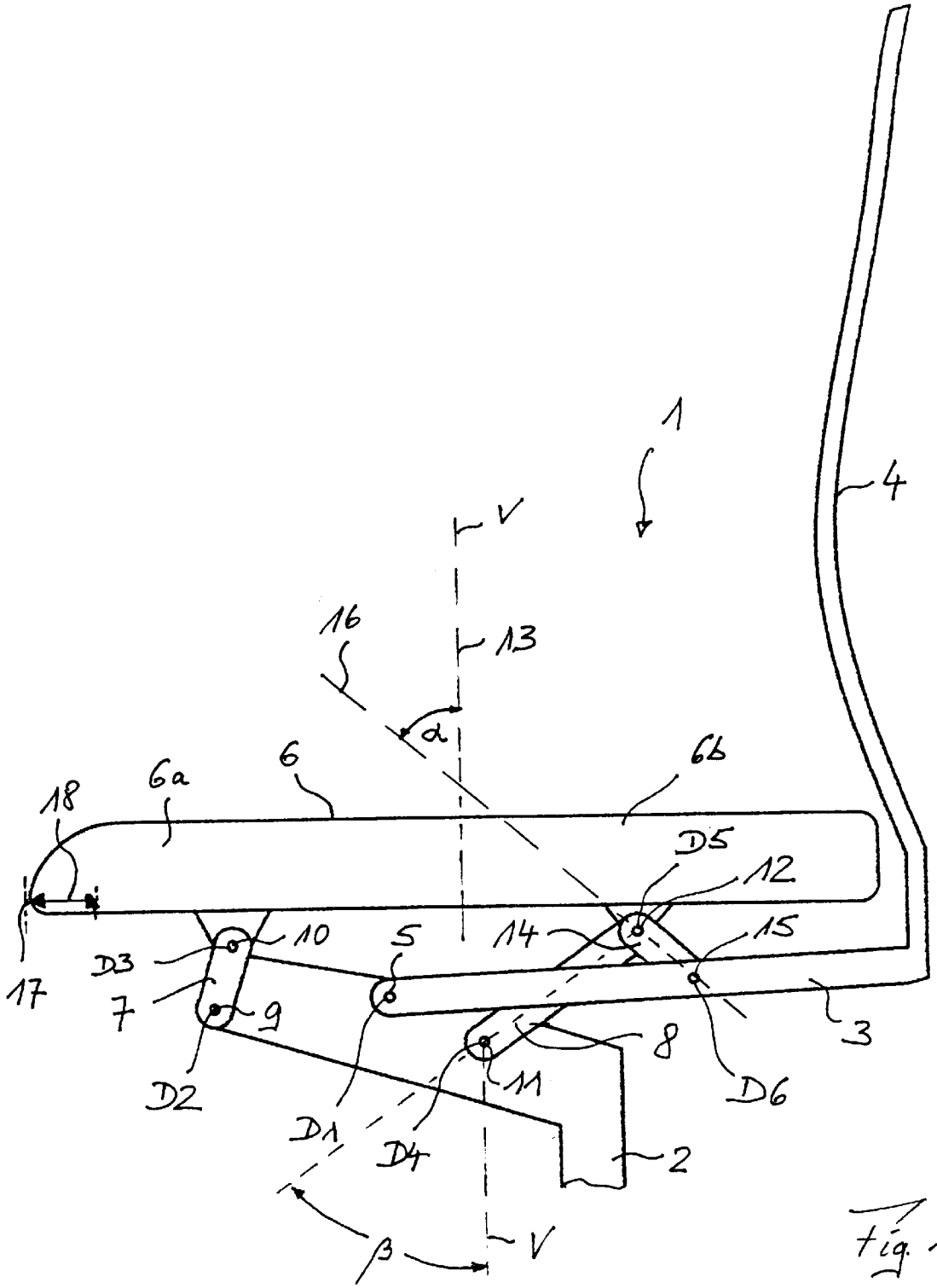
FIG. 1 is a side-elevational view of an office chair in a rest position according to the invention.
Figure 3:
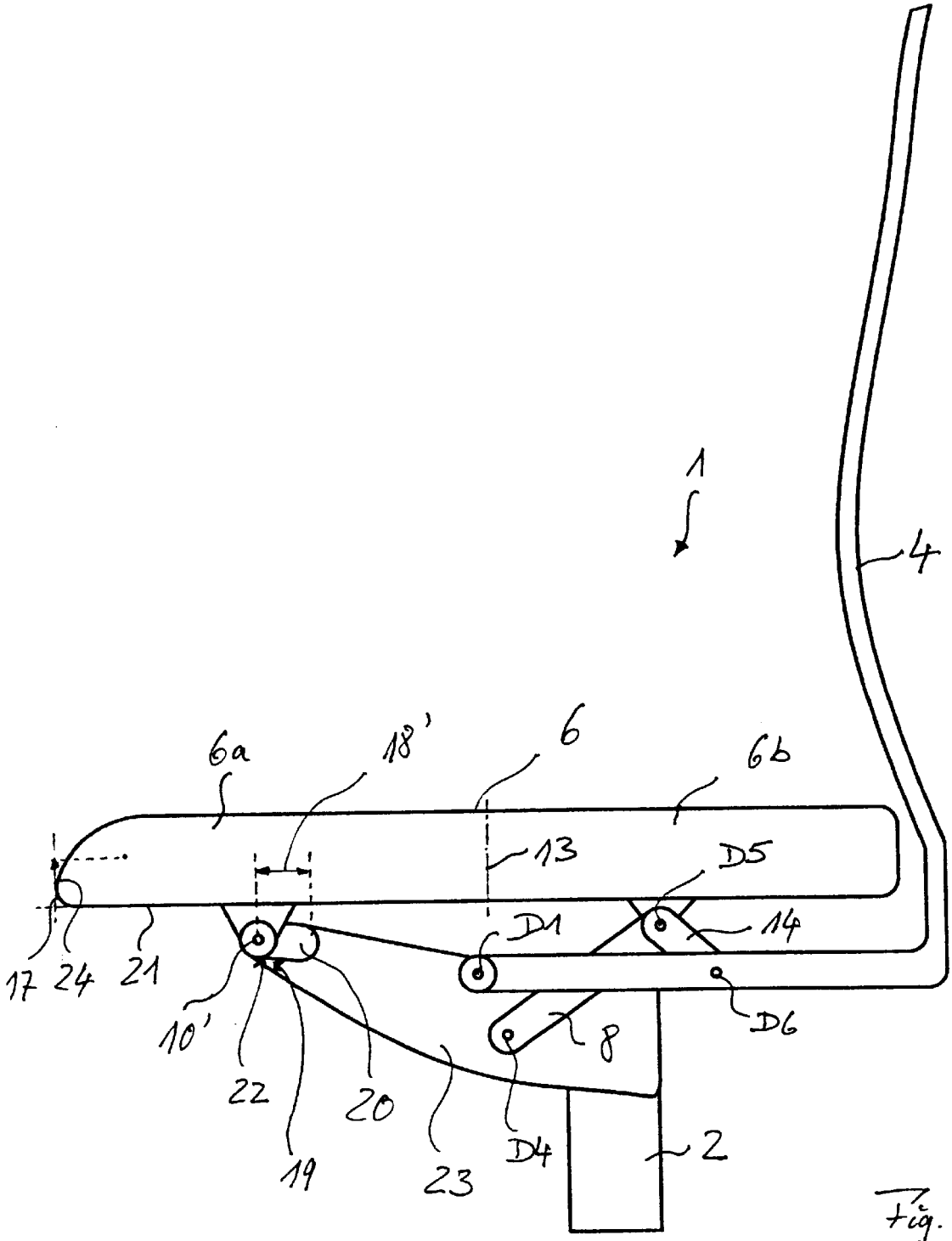
FIG. 3 is a side-elevational view of an alternative embodiment of the office chair in the rest position.

In all the figures of the drawing, sub-features and integral parts that correspond to one another bear the same reference symbol in each case. Referring now to the figures of the drawing in detail and first, particularly, to FIG. 1 thereof, there is shown a chair 1. The chair 1 is configured as an office chair and contains a seat carrier 2 that is fixed to a stand (not illustrated specifically). A backrest 4 is connected rotatably to the seat carrier 2 via a backrest link 3. The backrest 4 can be inclined here in a rearward direction out of a rest position, which is shown in FIGS. 1 and 3. The backrest 4 is inclined here by rotation about a point of rotation D1. For this purpose, the backrest link 3, which is fixed to the backrest 4, is connected to the seat carrier 2 via a rotary spindle 5, the point of rotation D1 being realized essentially by a center axis of the rotary spindle 5.

Figure 2:
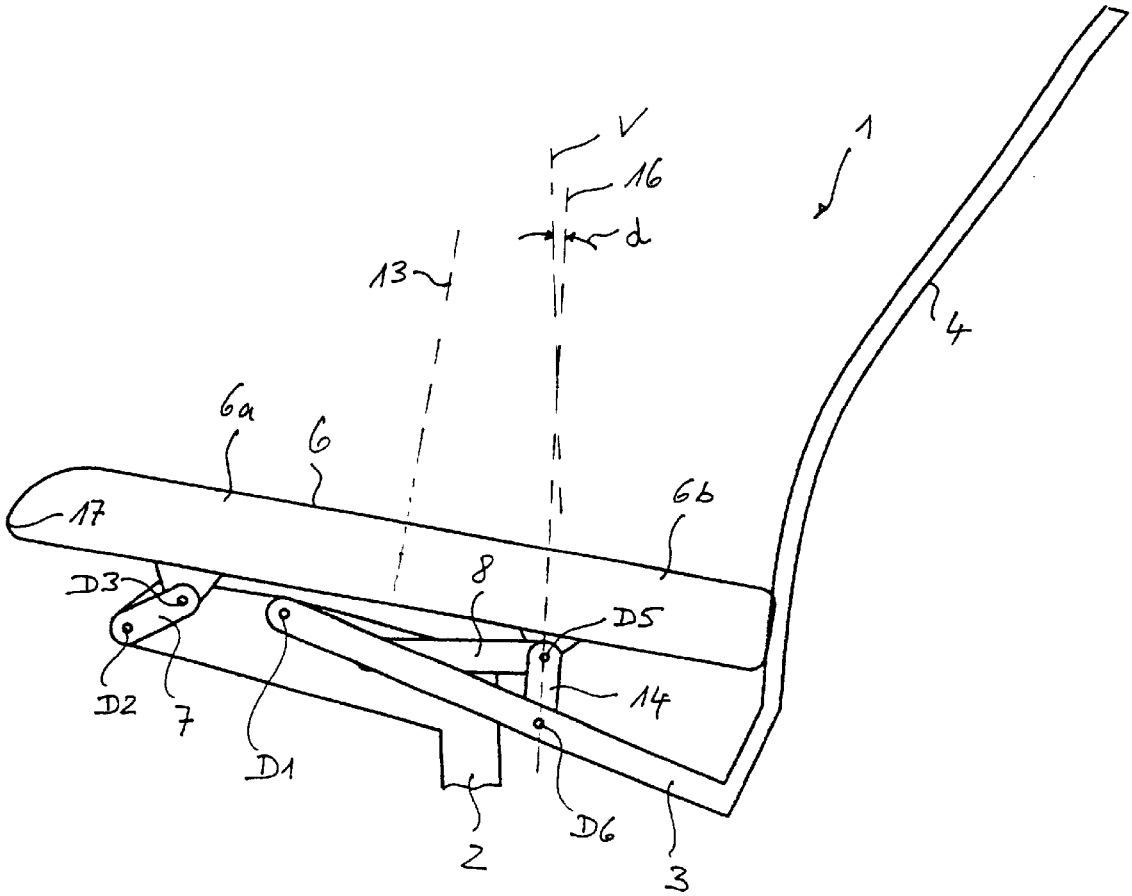
FIG. 2 is a side-elevational view of the office chair in a rearwardly inclined end position.

In the embodiment according to FIGS. 1 and 2, a seat surface 6 is also articulated on the seat carrier 2 via a front, first seat link 7 and a rear, second seat link 8. The front seat link 7 is connected rotatably to the seat carrier 2 via a rotary articulation D2 and to the seat surface 6 via a rotary articulation D3. The points of rotation D2 and D3, in turn, are respectively realized by corresponding rotary spindles 9 and 10, via which the front seat link 7 is connected rotatably to the seat carrier 2, on the one hand, and to the seat surface 6, on the other hand. The rear seat link 8 is analogously connected rotatably, on the one hand, to the seat carrier 2 via a point of rotation D4, which is realized by a rotary spindle 11, and, on the other hand, to the seat surface 6 via a point of rotation D5, which is realized by a rotary spindle 12.

Both the front seat link 7 and the rear seat link 8 are disposed in an inclined manner. In this case, the inclination of the rear seat link 8 in relation to a vertical V is greater than the inclination of the front seat link 7. In the rest position illustrated in FIG. 1, the vertical V coincides with a center longitudinal axis 13 which virtually subdivides the seat surface 6 into a front half 6*a* and a rear seat half 6*b*. In relation to the vertical center longitudinal axis 13, the front seat link 7 is disposed on the front half 6*a* of the seat surface 6. The front half 6*a* being directed away from the backrest 4, while the second seat link 8 is disposed on the rear half 6*b* of the seat surface 6. The rear half 6*b* being directed toward the backrest 4. Both in the case of the front seat link 7 and in the case of the rear seat link 8, the distances between the respective top points of rotation D3 and D5, connected to the seat surface 6, thereof and the backrest 4 is smaller than the distances between the respectively bottom points of rotation D2 and D4, connected to the seat carrier 2, thereof and the backrest 4. In this case, the rear seat link 8 is at least 25% longer than the front seat link 7.

In addition, in the rest position according to FIG. 1, the rear seat link 8 is in a flatter state, and is thus inclined to a more pronounced extent, than the front seat link 7. The angle of inclination $\beta$ of the rear (second) seat link 8 in relation to the vertical V—with the backrest 4 not in an inclined position—is $\beta=(45+30)°$, preferably approximately $\beta=45°$, the inclination, starting from the seat carrier 2, running in the upward and rearward directions to the backrest 4.

The backrest carrier 3 is connected to the seat surface 6 via a coupling link 14. The latter is connected to the backrest carrier 3 via a point of rotation D6, which is realized in turn by a corresponding rotary spindle 15, and to the seat surface 6 via the rotary articulation D5. In the rest position, the coupling link 14 is inclined, in turn, at an angle of inclination a in relation to the vertical center longitudinal axis 13. In relation to the vertical V, the angle of inclination $\alpha$ in the rest position, which is illustrated in FIGS. 1 and 3, is $0°<\alpha<90°$, for example 60° to 75°, preferably (45+10)°, in particular approximately 45°. The direction of inclination of the coupling link 14 here is opposed to that of the two seat links 7 and 8.

If the backrest 4 is inclined rearward into a position illustrated in FIG. 2, then, by virtue of this inclination, the backrest carrier 3 is rotated in the clockwise direction and, as a result, the coupling link 14 as a whole is moved downward. In this case, the angle a in relation to the vertical V decreases correspondingly. In the end position, a coupling-link axis 16, which runs through the two points of rotation D5 and D6 of the coupling link 14, is located more or less parallel to the center longitudinal axis 13 of the seat surface 6, the axis then running obliquely in relation to the vertical V.

As a result of the inclination of the backrest 4, together with the point of rotation D5, the rear seat link 8 and the seat surface 6 are lowered in their rear region 6*b*. At the same time, the front seat link 7 is thus also moved in the clockwise direction, as a result of which the top point of rotation D3 of the front seat link 7 is also lowered. The front, top point of rotation D3 is lowered to a lesser extent than the rear, top point of rotation D5 of the seat surface 6, with the result that the latter, as a whole, is lowered and inclined in the clockwise direction. At the same time, a front edge 17 of the seat surface 6 moves in the rearward direction, the length compensation which is necessary for this purpose taking place by way of the front seat link 7. The resulting displacement of the front edge 17 of the seat surface 6 is illustrated by a length arrow 18 in FIG. 1.

Figure 4:
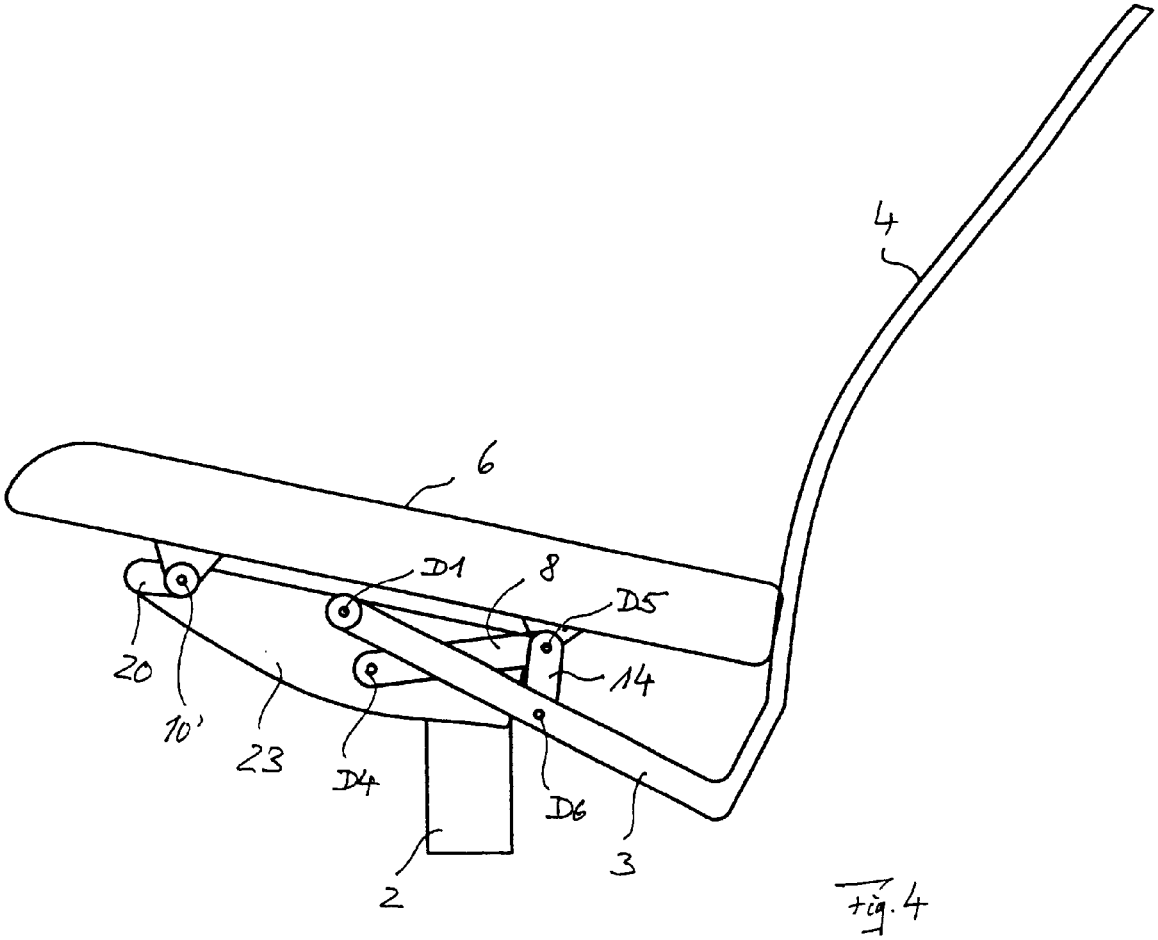
FIG. 4 is a side-elevational view of the alternative embodiment of the office chair in a rearwardly inclined end position.

An alternative embodiment for realizing the length compensation is illustrated in FIGS. 3 and 4, which, in turn, respectively show a corresponding chair with the backrest 4 in the rest position and in an inclined position. In this embodiment, a slot guide 19 is provided instead of the front seat link. The slot guide 19 is realized by a slot 20 in which a spindle 10', which is connected to the seat surface 6 on the underside 21 of the latter, can be displaced in the direction of an arrow 18'. The slot 20 is provided at a free end 22 of a carrying arm 23 of the seat carrier 2. In this embodiment, the front edge 17 of the seat surface 6 is raised in the direction of an arrow 24, illustrated in FIG. 3, with the backrest 4 in the rearwardly inclined end position.

We claim:

1. A chair, comprising:

a seat carrier;

a backrest carrier;

a backrest supported on said backrest carrier for inclining said backrest relative to said seat carrier;

a seat surface having a front half and a rear half;

at least one seat link including both a front, first seat link and a rear, second seat link, said seat surface being connected rotatably to said seat carrier through said front, first seat link and said rear, second seat link, said seat surface to be moved synchronously with said backrest and supported on said seat carrier through said at least one seat link;

a coupling link for synchronization of a movement of said backrest and a movement of said seat surface, said coupling link connected rotatably, on a first side, to said seat surface and, on a second side, to said backrest carrier;

said front, first seat link being disposed in an inclined manner in a region of said front half of said seat surface, said front, first seat link connected rotatably to said seat surface around a first point of rotation and, said front, first seat link also connected to said seat carrier around a second point of rotation, a distance between the first point of rotation and said backrest being smaller than a distance between the second point of rotation and said backrest; and said rear, second seat link being disposed in an inclined manner in a region of said rear half of said seat surface, said rear, second seat link connected rotatably to said seat surface around a third point of rotation and also connected to said seat carrier around a fourth point of rotation, a distance between the third point of rotation and said backrest being smaller than a distance between the fourth point of rotation and said backrest.

2. The chair according to claim 1, wherein an inclination of said rear, second seat link is greater than an inclination of said front, first seat link.

3. The chair according to claim 1, wherein said coupling link has points of rotation, and at least one of the points of rotation of said coupling link is provided in a rear half of said seat surface, said rear half being directed toward said backrest.

4. The chair according to claim 3, wherein one of the points of rotation of said coupling link coincides with the third point of rotation.

5. The chair according to claim 1, wherein if said backrest is not in an inclined position, said rear, second seat link is inclined by an angle $\beta=(45\pm30)°$ in relation to a vertical.

* * * * *

UNITED STATES PATENT AND TRADEMARK OFFICE

CERTIFICATE OF CORRECTION

PATENT NO. : 6,709,057 B2
DATED : March 23, 2004
INVENTOR(S) : Armin Sander et al.

It is certified that error appears in the above-identified patent and that said Letters Patent is hereby corrected as shown below:

Title page,
Item [75], Inventors, should read as follows:
-- Armin Sander, Fürth (DE); Martin Potrykus, Bamberg (DE) --.
Item [73], Assignee, should read as follows:
-- Armin Sander, Nürnberg (DE) --.

Signed and Sealed this

Twenty-fifth Day of May, 2004

JON W. DUDAS
*Acting Director of the United States Patent and Trademark Office*